US009752285B2

(12) United States Patent
Hengelmann et al.

(10) Patent No.: US 9,752,285 B2
(45) Date of Patent: Sep. 5, 2017

(54) SLEEPER BLOCK UNIT FOR RAILWAY TRACK SYSTEMS

(71) Applicant: SONNEVILLE AG, Luterbach (CH)

(72) Inventors: Anabel Hengelmann, Zurich (CH); Martin Fink, Bern (CH); Marco Habegger, Grosshöchstetten (CH)

(73) Assignee: SONNEVILLE AG (CH)

( * ) Notice: Subject to any disclaimer, the term of this patent is extended or adjusted under 35 U.S.C. 154(b) by 72 days.

(21) Appl. No.: 14/771,565

(22) PCT Filed: Mar. 7, 2014

(86) PCT No.: PCT/EP2014/054492
§ 371 (c)(1),
(2) Date: Aug. 31, 2015

(87) PCT Pub. No.: WO2014/139898
PCT Pub. Date: Sep. 18, 2014

(65) Prior Publication Data

US 2016/0017544 A1 Jan. 21, 2016

(30) Foreign Application Priority Data

Mar. 11, 2013 (EP) ..... 13158600

(51) Int. Cl.
*E01B 1/00* (2006.01)
*E01B 3/28* (2006.01)

(52) U.S. Cl.
CPC ..... *E01B 1/005* (2013.01); *E01B 3/28* (2013.01)

(58) Field of Classification Search
CPC . E01B 1/00; E01B 1/001; E01B 1/002; E01B 1/004; E01B 1/005; E01B 3/28; E01B 3/30
See application file for complete search history.

(56) References Cited

U.S. PATENT DOCUMENTS 4,609,144 A * 9/1986 Harmsen ..... E01B 1/005 238/1
5,551,631 A * 9/1996 Cailliau ..... E01B 1/00 238/109

(Continued)

FOREIGN PATENT DOCUMENTS

CA 2598637 A1 3/2008
CN 1083147 A 3/1994

(Continued)

OTHER PUBLICATIONS

European Search Report dated Aug. 6, 2013 issued in corresponding European patent application No. 13 15 8600.

(Continued)

*Primary Examiner* — Jason C Smith
(74) *Attorney, Agent, or Firm* — Ostrolenk Faber LLP

(57) ABSTRACT

The sleeper block unit (1) for railway track systems consists of a sleeper block (2) and of a sleeper shoe (3) that partly surrounds the sleeper block (2). The sleeper block (2) has a head portion (4) and a base portion (6), the head portion (4) extending beyond the base portion (6) in length and in width, thus forming a step (10). At the upper edge of the sleeper shoe (3), a surrounding, upwardly and outwardly extending sealing lip (14) that lies against the step (10) is arranged. As a result, during vertical movements of the sleeper block (2) in the sleeper shoe (3), the sealing lip (14) is deformed substantially vertically in the elastic range rather than rubbing against an outer wall of the sleeper block as in known sleeper block units. In this manner the sealing lip is subject to reduced wear so that the sealing effect is maintained for a longer period and the sleeper block unit (1) has a longer lifetime.

4 Claims, 1 Drawing Sheet

(56) References Cited

U.S. PATENT DOCUMENTS

| | | | | |
|---|---|---|---|---|
| 6,283,383 | B1 * | 9/2001 | Blank | E01B 1/005 238/109 |
| 9,410,293 | B2 * | 8/2016 | Rodriguez Plaza | E01B 3/28 |
| 2008/0083835 | A1 * | 4/2008 | Girardi | E01B 1/005 238/29 |
| 2013/0277441 | A1 * | 10/2013 | Laborenz | E01B 1/004 238/3 |
| 2016/0017544 | A1 * | 1/2016 | Hengelmann | E01B 3/28 238/55 |

FOREIGN PATENT DOCUMENTS

| | | | |
|---|---|---|---|
| CN | 1269856 | A | 10/2000 |
| DE | 43 35 516 | A1 | 4/1995 |
| DE | 102009000316 | A1 | 7/2010 |
| DE | 101 96 374 | B4 | 1/2012 |
| EP | 0 533 645 | A1 | 3/1993 |
| EP | 0 915 202 | A1 | 5/1999 |
| EP | 0 919 666 | A1 | 6/1999 |
| EP | 1 006 239 | A1 | 6/2000 |
| EP | 1 017 906 | B1 | 12/2003 |
| FR | 2 648 489 | A1 | 12/1990 |
| FR | 2 740 788 | A1 | 5/1997 |
| FR | 2 840 330 | A1 | 12/2003 |
| GB | 1538997 | A | 1/1979 |

OTHER PUBLICATIONS

International Search Report dated Jul. 23, 2014 issued in corresponding International patent application No. PCT/EP2014/054492.
Patent Office of the People's Republic of China Search Report dated Jun. 22, 2016 in corresponding Chinese Patent Application No. 2014800130766 (with English language translation)(total 4 pages).

* cited by examiner

SLEEPER BLOCK UNIT FOR RAILWAY TRACK SYSTEMS

CROSS REFERENCE TO RELATED APPLICATIONS

The present application is a 35 U.S.C. §371 National Phase conversion of PCT/EP2014/054492, filed Mar. 7, 2014, which claims benefit of European patent application no. 13158600.0, filed Mar. 11, 2013, the disclosure of which is incorporated herein by reference. The PCT International Application was published in the German language.

TECHNICAL FIELD OF THE INVENTION

The invention relates to a sleeper block unit for railway track systems, consisting of a sleeper block and of a sleeper shoe that partly surrounds the sleeper block, the sleeper block having a head portion and a base portion with side wall surfaces and a bottom surface, and the head portion being longer and larger than the base portion such that a step is formed between the head portion and the base portion.

BACKGROUND OF THE INVENTION

Sleeper block units are used in so-called slab tracks which are increasingly preferred to so-called ballasted tracks since they allow an increased performance of the track with regard to the attainable speeds and reduced maintenance costs. Such sleeper block units generally comprise a block made of concrete, a shoe generally made of shaped rubber that receives the block, and a resilient elastomer pad that is arranged between the bottom of the block and the bottom of the shoe. On the upper side of the block, a fastening system for a rail is arranged. The shoe is encased in concrete.

In patent DE10196374B4 it is explained that in such sleeper block units the dynamic to static rigidity ratio increases with the vertical movement of the block and therefore the deformation of the elastomer pad under dynamic loads is impeded by an interface between the block and the shoe wall, and that this interface is a phenomenon known as the wedge effect. The cited patent then describes a solution for eliminating the wedge effect without reducing the lateral resistance of the track and for decreasing the dynamic to static rigidity ratio. It is evident that the rigidity and the damping behavior of a sleeper block unit are adversely influenced when water, dust, dirt, laitance or the like enter between the block and the shoe, particularly when infiltrated water freezes. Therefore, measures aiming to seal the space between the block and the shoe have already been suggested.

The references EP1017906B1 and DE4335516A1 both show a sleeper block having a partly surrounding sleeper shoe where a resilient sealing lip lying against the substantially vertically oriented outer wall of the sleeper block is arranged at the upper edge of the sleeper shoe. These arrangements suffer from the disadvantage that during vertical movements of the sleeper block the sealing lip rubs against the outer wall of the sleeper block and is therefore subject to wear so that the sealing effect decreases over time. The reference EP0915202A1 describes a sleeper block and sleeper shoe assembly where the latter has a surrounding sealing arrangement at its upper edge that sealingly engages in a dedicated surrounding groove in the sleeper block. This groove complicates the manufacture of the sleeper block. Ultimately, patent application FR2840330A1 describes a sleeper block and sleeper shoe assembly where the latter has a relatively complicated sealing arrangement at its upper edge that is produced by means of a flowable sealing material.

On the background of this prior art it is the object of the invention to provide a sleeper block unit of the kind mentioned in the introduction where the sealing arrangement is of simple design and nevertheless subject to little wear in operation.

SUMMARY OF THE INVENTION

According to the invention, this object is achieved in that a surrounding, upwardly and outwardly extending sealing lip that lies against the step is arranged at the upper edge of the sleeper shoe.

In particular, this inventive solution offers the advantage that during vertical movements of the sleeper block in the sleeper shoe, the sealing lip is deformed substantially vertically in the elastic range rather than rubbing against an outer wall of the sleeper block as in known sleeper block units. In this manner the sealing lip is subject to lower wear so that the sealing effect is maintained for a longer period and the sleeper block unit has a longer lifetime.

According to one embodiment of the invention, the step forms a contact surface portions of which are oriented at least approximately parallelly to the bottom surface. This contact surface compresses the sealing lip vertically when the sleeper block is pressed into the sleeper shoe.

According to a further embodiment, a junction area between the side walls of the base portion and the step is rounded. The sealing lip advantageously fits into this rounded portion so that a relatively large contact area between the sealing lip and the sleeper block results.

According to a further embodiment, a surrounding, outwardly directed nose is provided on the sleeper shoe in the area of the base of the sealing lip. On one hand, this nose serves as an indicator of the level of concrete in which the sleeper block unit is to be encased, and on the other hand, the nose forms a stable base for the sealing lip.

Ultimately, according to an additional embodiment, both the base portion of the sleeper block and the sleeper shoe diminish in length and width from top to bottom. This allows a replacement of the encased sleeper block unit without breaking up the surrounding concrete.

BRIEF DESCRIPTION OF THE DRAWINGS

An exemplary embodiment of the invention will be described in more detail hereinafter by way of example with reference to the appended drawings showing FIG. 1 a partly sectioned view of the long side of a sleeper block unit.

DESCRIPTION OF EMBODIMENTS

Figure 1:
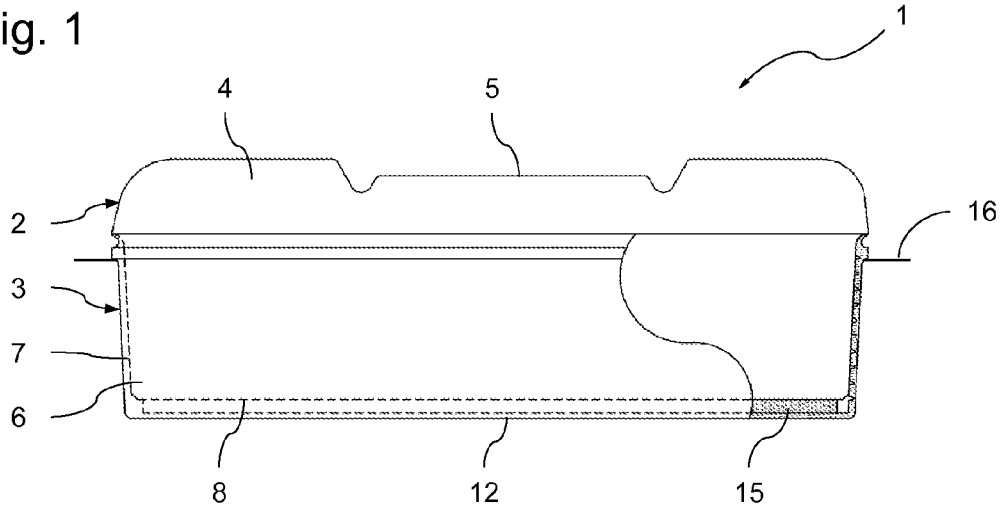
Figure 2:
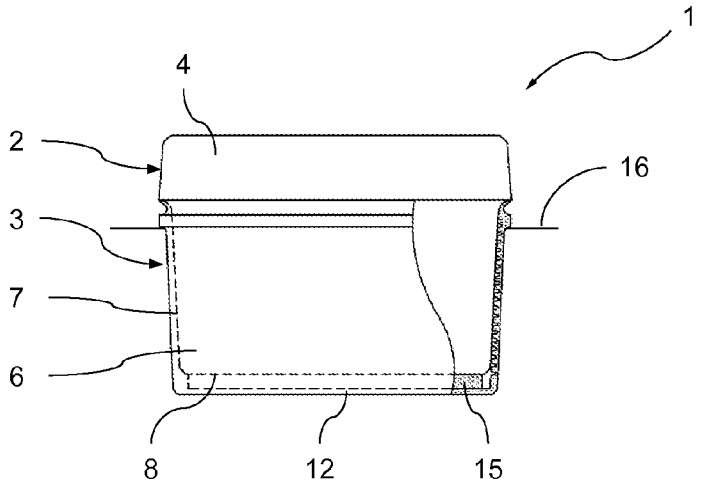
FIG. 2 a partly sectioned view of the short side of the same sleeper block unit.

FIGS. 1 and 2 show partly sectioned side elevations of an exemplary embodiment of a sleeper block unit 1 according to the invention showing the long and the short sides of sleeper block unit 1, respectively, that has a substantially rectangular plan view. Except the sealing lip 14 that will be described below, sleeper block unit 1 corresponds to the one described in document DE10196374B4 and consists of a sleeper block 2 made of concrete and of a sleeper shoe 3 that surrounds the latter on part of its height and is made of an elastomeric material, preferably of rubber. Sleeper block 2 has a head portion 4 with a bearing surface 5 for rail fastening means (not shown). Sleeper block 2 further comprises a base portion 6 that is shorter and narrower than head portion 4 so that a step 10 is formed between head portion 4 and base portion 6. The side wall surfaces 7 of base portion 6 are slightly inclined such that the length and the width of base portion 6 decrease toward the bottom. This allows replacing sleeper block unit 1 without the need of breaking up the surrounding concrete. Reference numeral 8 denotes the bottom surface of sleeper block 2. The aforementioned step 10 forms a surrounding contact surface whose outer part is oriented at least approximately parallelly to bottom surface 8 and whose function will be explained below. The junction 9 between side wall surfaces 7 and step 10 is preferably rounded as illustrated.

Sleeper shoe 3 has four side walls 11 and a bottom 12, and between bottom surface 8 of sleeper block 2 and bottom 12 of sleeper shoe 3, a resilient inlay 15 is arranged which in operation under load allows a vertical movement of sleeper block 2 in sleeper shoe 3. On the outer walls 11 of sleeper shoe 3, a horizontally extending nose 13 is arranged which serves as an orientation for the concrete level to be observed while sleeper block unit 1 is being encased and is indicated in FIGS. 1 and 2 by line 16.

Figure 3:
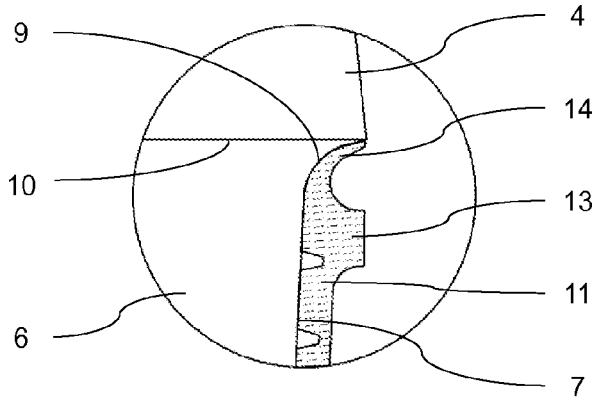
FIG. 3 a detail of FIG. 1 or 2, respectively, on an enlarged scale.

As seen particularly clearly in the enlarged detail view of FIG. 3, a surrounding sealing lip 14 is arranged at the upper edge of sleeper shoe 3 whose free end extends outwardly and lies against the lower side of the contact surface formed by step 10. In operation, when sleeper block 2 moves vertically and inlay 15 is compressed, sealing lip 14 is resiliently bent by the contact surface while always remaining in contact with the contact surface and thus reliably sealing the space between sleeper shoe 3 and sleeper block 2. The resilient bending movement produces relatively little friction between sealing lip 14 and sleeper block 2 so that the sleeper block unit according to the invention has a longer lifetime than known sleeper block units in spite of its simpler design.

LIST OF REFERENCE NUMERALS

1 sleeper block unit
2 sleeper block
3 sleeper shoe
4 head portion
5 bearing surface
6 base portion
7 side wall surfaces of 6
8 bottom surface of 6
9 junction
10 step
11 side wall of 3
12 bottom of 3
13 nose
14 sealing lip
15 inlay
16 line (concrete level)
17
18
19
20

What is claimed is:

1. A sleeper block unit for railway track systems, the sleeper block unit comprising:

a sleeper block and a sleeper shoe that partly surrounds the sleeper block;

the sleeper block comprising a head portion and a base portion with side wall surfaces and a bottom surface;

the head portion being longer and larger than the base portion such that a step is formed between the head portion and the base portion, wherein the step forms a contact surface, a portion of which is oriented at least approximately parallel to the bottom surface; and a surrounding sealing lip extending upwardly and outwardly, the sealing lip comprising a free end lying upwards against the contact surface formed by the step.

2. The sleeper block unit according to claim 1 wherein a junction area between the side walls of the base portion and the step is rounded.

3. The sleeper block unit according to claim 1, wherein a surrounding, outwardly directed nose is provided on the sleeper shoe in the area of the base of the sealing lip.

4. The sleeper block unit according to claim 1, wherein both the base portion of the sleeper block and the sleeper shoe diminish in length and width from top to bottom.

* * * * *